US009635464B2

(12) United States Patent
So et al.

(10) Patent No.: US 9,635,464 B2
(45) Date of Patent: Apr. 25, 2017

(54) MEMBRANE AND METHOD FOR PRODUCING DIAPHRAGM, AND COMPOSITE DIAPHRAGM

(71) Applicants: True Honest Company Limited, Hong Kong (HK); Furukawa Electric Hong Kong Limited, Hong Kong (HK)

(72) Inventors: Muk Chung Roger So, Hong Kong (HK); Mugino Eddie Akira, Guangdong (CN)

(73) Assignees: TRUE HONEST COMPANY LIMITED, Hong Kong (HK); FURUKAWA ELECTRIC HONG KONG LIMITED, Hong Kong (HK)

( * ) Notice: Subject to any disclaimer, the term of this patent is extended or adjusted under 35 U.S.C. 154(b) by 0 days.

(21) Appl. No.: 14/904,948

(22) PCT Filed: May 1, 2014

(86) PCT No.: PCT/CN2014/076692
§ 371 (c)(1),
(2) Date: Jan. 14, 2016

(87) PCT Pub. No.: WO2015/165119
PCT Pub. Date: Nov. 5, 2015

(65) Prior Publication Data
US 2016/0142823 A1 May 19, 2016

(51) Int. Cl.
*H04R 7/00* (2006.01)
*H04R 7/12* (2006.01)

(52) U.S. Cl.
CPC ..... *H04R 7/125* (2013.01); *H04R 7/00* (2013.01); *H04R 7/127* (2013.01); *H04R 2231/00* (2013.01); *H04R 2307/025* (2013.01)

(58) Field of Classification Search
CPC ..... H04R 7/125; H04R 7/00; H04R 7/127
USPC ..... 181/173, 167
See application file for complete search history.

(56) References Cited

U.S. PATENT DOCUMENTS

| | | | | |
|---|---|---|---|---|
| 6,543,573 | B2 * | 4/2003 | Ishihara | H04R 7/00 181/167 |
| 7,123,738 | B1 * | 10/2006 | Mizone | F21S 10/02 381/333 |
| 2004/0112672 | A1 * | 6/2004 | Ono | H04R 7/125 181/169 |
| 2011/0155501 | A1 * | 6/2011 | Chen | H04R 7/06 181/167 |

(Continued)

*Primary Examiner* — Forrest M Phillips

(57) ABSTRACT

A membrane and a method for producing a diaphragm, and a composite diaphragm are provided. The MCPET material is a MCPET baffle with micropores independent from each other; wherein an average size of the micropore is smaller than or equal to 5 μm, a foaming rate of the MCPET baffle is less than 2 times, and a density of the MCPET baffle is less than 300 kg/m3. The MCPET baffle is further processed by means of layered cut to form the membrane that is thinner than the MCPET baffle. At least one surface with micropores is exposed to form a micropore exposed surface. The membrane is heated under a temperature of 130-140° C. to form the diaphragm. The composite diaphragm includes a main diaphragm and an auxiliary diaphragm, wherein the main diaphragm is made of the membrane of the present application. The diaphragm made of the membrane has a superior sound performance.

10 Claims, 5 Drawing Sheets

(56) References Cited

U.S. PATENT DOCUMENTS

2013/0259291 A1* 10/2013 Fujitani ..... H04R 7/127
381/423

* cited by examiner

MEMBRANE AND METHOD FOR PRODUCING DIAPHRAGM, AND COMPOSITE DIAPHRAGM

TECHNICAL FIELD

The present application relates to the field of electroacoustic device and audio product manufacturing technology, and relates to a membrane for producing an audio speaker diaphragm, a method for forming the diaphragm using the membrane, and a diaphragm product formed by the aforesaid membrane and the method using the membrane, and more particularly, relates to an audio speaker diaphragm made of the MCPET material.

BACKGROUND

For an audio speaker, a diaphragm is a core component of the audio speaker and the performance of the diaphragm has great effects on the performance of the audio speaker. In the prior art, different materials, such as paper pulp, polypropylene and metal materials etc., but traditional audio speakers made of these materials have drawbacks in audible sound reproduction. For example, the diaphragm made of paper pulp is sensitive to humidity and the temperature and non-durable; the humidity resistance thereof is bad; the water can be absorbed by it. As a result, the diaphragm made of paper pulp tends to be degraded after being used for a period of time; the wet weather condition accelerates the process of degrading. Meanwhile, the heat resistance of the diaphragm made of paper pulp is bad too, and in high temperature environment, the diaphragm made of paper pulp may be deformed over time. Therefore, the paper cone is sensitive to the temperature and the humidity, and the changes of the using environment may have a certain impact on the sound; besides, the changes of the using environment may cause the paper cone to produce irrecoverable deformations. Therefore, the performance of many audio speakers employing the diaphragm made of paper pulp is degraded after the audio speakers are used for a period of time. Compared with the diaphragm made of paper pulp, the diaphragm made of polypropylene is at lower density and poor in heat resistant. The diaphragm made of metal has a strong rigidity and low resistance and the energy will not be absorbed by the diaphragm itself, so when the paper cone is split, there is an obvious formant at the high point of the frequency response. If not properly handled, the formant will easily lead to "metallic sound", which means the harmonic distortion may be formed during the process of the sound reproduction.

To overcome these drawbacks, in the prior art there is an alternative solution of using the polyethylene terephthalate (PET) sheet (hereinafter called PET sheet) containing micropores having the average size of 10-30 microns to make the audio speaker diaphragm. The diaphragm made of such solution has a better elasticity level and a lighter weight, which can ensure that the audio speaker diaphragm is durable, and produces less distortion during the sound reproduction process. However, the audio speaker diaphragm made of PET sheet still has the following problems: firstly, during the production, it needs to make sure that the foaming PET sheet is sufficiently foamed, the PET sheet is too thick (the limiting value of the present thickness is 0.85 mm), compared with the existing audio speaker diaphragm with micropores; secondly, the microspores are still too large, which will affect the best adaption between the density level and the rigidity level. Therefore, the foaming PET sheet in the prior art is not recognized as the best material for producing audio speaker diaphragm in industry. For a long time, people have been seeking for new materials to make diaphragms and until now there are still many researchers and research institutions working on it, so the prior art still needs to be improved.

BRIEF SUMMARY

An object of the present application is to provide a membrane and a method for producing a diaphragm and a composite diaphragm, in order to provide a new membrane material for producing an audio speaker diaphragm, and meanwhile to provide a method using the membrane material to produce the membrane, and an audio speaker diaphragm with a good overall performance made of this membrane material.

A membrane for producing a diaphragm according to the present application, the membrane is made of MCPET material which is a MCPET baffle with micropores; an average size of the micropore is smaller than or equal to 5 μm; the micropores are independent from each other; a foaming rate of the MCPET baffle is less than 2 times; a density of the MCPET baffle is less than 300 kg/m$^3$; the MCPET baffle is further processed by means of layered cut to form the membrane which is thinner than the MCPET baffle being processed; and at least one surface with micropores is exposed to form a micropore exposed surface.

Preferably, a thickness of the membrane is 0.05-1 mm, and more preferably, the thickness of the membrane is 0.05-0.4 mm.

A method for producing an audio speaker diaphragm, wherein the method comprises the following steps: cutting a MCPET baffle with micropores in layers to form the membrane which is thinner than the MCPET baffle being cut; and heating the membrane under a temperature of 130-140° C. to form the diaphragm; wherein an average size of the micropore is smaller than or equal to 5 μm; the micropores are independent from each other; a foaming rate of the MCPET baffle is less than 2 times; a density of the MCPET baffle is less than 300 kg/m$^3$; a thickness of the membrane is 0.05-1 mm; at least one surface with micropores is exposed to form a micropore exposed surface.

Preferably, the entire membrane is heated to form conical diaphragm configurations or dome diaphragm configurations or flat diaphragm configurations with a concave radiating surface; and each diaphragm configuration is split from the entire diaphragm by means of punching or cutting.

Preferably, a forming method of one surface heating or two surfaces heating is used; when there is only one micropore exposed surface, the surface which is contacted with a mould is micropore non-exposed surface, regardless of using the forming method of one surface heating or two surfaces heating.

An audio speaker composite diaphragm according to the present application, comprising a main diaphragm and an auxiliary diaphragm, wherein the main diaphragm is made of a MCPET baffle with micropores; an average size of the micropore is smaller than or equal to 5 μm; the micropores are independent from each other; a foaming rate of the MCPET baffle is less than 2 times; a density of the MCPET baffle is less than 300 kg/m$^3$; the MCPET baffle is further cut in layers to form a membrane; at least one surface with micropores is exposed to form a micropore exposed surface; a thickness of the membrane is 0.05-1 mm; the membrane is further heated under a temperature of 130-140° C. to form the main diaphragm; the auxiliary diaphragm is in shape of a circular or an annular; an external diameter of the auxiliary diaphragm is larger than an external diameter of the main diaphragm; and the main diaphragm is superposed on the auxiliary diaphragm and is located at the center of the auxiliary diaphragm.

Preferably, when there is only one micropore exposed surface on the membrane, the micropore exposed surface is opposite to a sound transmission direction of the main diaphragm.

Preferably, the main diaphragm is a conical diaphragm, a flat diaphragm with a concave radiating surface, or a dome diaphragm.

Preferably, an annular connected edge is defined on the main diaphragm; the main diaphragm is superposed onto the auxiliary diaphragm via the annular connected edge; and the main diaphragm and the auxiliary diaphragm are pasted or thermal bonded together to form a composite diaphragm.

Preferably, the auxiliary diaphragm is made of paper pulp or polymer material; a stiffening ring is fixed on a cylindrical edge of the auxiliary diaphragm.

The membrane for producing the diaphragm of the present application is made of the MCPET material, and more specifically is made of the MCPET baffle which has the following features: an average size of the micropore is smaller than or equal to 5 μm; the micropores are independent from each other; a foaming rate of the MCPET baffle is less than 2 times; a density of the MCPET baffle is less than 300 kg/m$^3$. The MCPET baffle is developed by the Japan's Furukawa Electric Co., Ltd. aiming at improving the illuminating brightness, and the MCPET baffle is also called ultra-fine foaming baffle. The ultra-fine foaming baffle is a baffle formed by the ultra-fine foaming technology using PET (polyethylene Terephthalate) as the base material, and the baffle has a very good reflection effect. This ultra-fine foaming baffle is named as MCPET (Microcellular formed Polyethylene Terephthalate) by Japan's Furukawa Electric Co., Ltd., and the micropores on the MCPET baffle are usually limited to 10 μm below during the producing process. The average size of the micropore is much less than the size of the commonly foamed polymer baffle, and thus it is called ultra-fine foaming baffle. Wherein, the baffle of the MCPET-VA series satisfies the requirements of the present application which requires the following features: the average size of the micropore is smaller than or equal to 5 μm; the micropores are independent from each other; the foaming rate is less than 2 times; a density is less than 300 kg/m$^3$. In order to ensure the adequacy of the foaming, the MCPET baffle made must have a certain thickness, and a too small thickness is difficult to ensure the uniformity of the adequacy of the foaming. The minimum thickness of the MCPET baffle of the company is 0.51 mm and the foaming rate is controlled to 1.5-2 times. As mentioned above, the foaming rate suitable for the present application is limited to 2 times below. The following advantages for MCPET are well-known: no more foaming agent is added to the MCPET during the producing process; it is ultra-fine foamed by means of using gas at a high temperature and pressure in a physical way. Therefore, the micropores are independent from each other; it can be disposed in a PET recycling mode; no hazardous materials are used; the surface is very smooth. Besides, the material has excellent light reflection characteristics with a total reflectance above 99%, a diffuse reflectance of 96% and a specular reflectance of 3%; it has a light weight and an excellent shock resistance; it is resistant to high temperature; it is not likely to deform from its original design shapes under a temperature of 160° C. if no external force is applied; blanking, punching, bending, heating and etc. can be used to further process the MCPET in the respect of secondary processing. The flame retardance of the MCPET material satisfies the UL94-HBF burning standard of the foaming material or above. Besides, because of these features of the MCPET material, the reflectivity of each wavelength of the light source may be maintained uniformly.

The differences between with the polymer material for producing diaphragms in prior art and the membrane for producing diaphragms in the present application are listed as below: firstly, the greatest difference is that the average size of micropore is smaller than 5 μm because of the ultra-fine foaming; secondly, the foaming rate of the present application is controlled to be less than 2 times; thirdly, the micropores are independent from each other; fourthly, the membrane for producing diaphragms in the present application is formed by processing the MCPET baffle that is thicker than the membrane by means of cutting, and thus at least one micropore exposed surface with micropores is formed, and at least one surface has open micropores defined thereon. But in the prior art, when using the polymer materials to produce diaphragms, a foaming agent is used in the process of foaming. In this way, the size of micropores formed in the process of foaming is larger than 10 μm, and even worse the micropores are connected to each other, which affects the sound transmission. Meanwhile, diaphragms made of polymer in the prior art are formed by the rolling of the press roll. For the diaphragms made of polymer, although a lot of micropores are formed in the base body, however, due to limitations of the production process in the prior art, for example when the membrane contacts with the press roll by which a dense film layer is formed on the upper surface and the lower surface of the membrane, which results in only few micropores exposed, and thus the number of micropores exposed can be even ignored.

In the present application, the small and independent micropore on the membrane make the membrane for producing diaphragms of the present application have high structural strength and elasticity in the case of low density. Micropores with open structures are formed by means of cutting. During the process of cutting, the force and the viscosity between the macromolecules of the MCPET membrane increase, thus making the MCPET membrane further hardened. With this hardening effect, the viscous phenomenon of the diaphragm is significantly improved.

Further, the open structure of the micropore essentially increases the vibration area, thus making the diaphragm made of the membrane of the present application have a higher sensitivity and a better ability of forming sound pressure by vibration.

After understanding the above, it is easy to understand why the diaphragm produced by the method of the present application and made of the membrane of the present application has an excellent sound performance. In the present application, a MCPET baffle with the following features is chosen: an average size of the micropore is smaller than 5 μm; a foaming rate of the MCPET baffle is less than 2 times. Then a membrane with exposed micropores is formed by cutting the MCPET baffle and the membrane is thinner than the MCPET baffle being cut.

Results show that within a frequency range of 20 Hz-5500 Hz, the diaphragm of the present application shows superior sound reproduction ability. The sound pressure loss is small and there is no sudden change. The reproductive sound pressure can be 112 db or more. The resolution of bass and median tone is good and music can be reproduced with high quality, thus making people have an excellent listening experience. Meanwhile, the sensitivity of the audio speaker using the diaphragm made of the membrane of the present application can reach to 116 db, while in the prior art the sensitivity of similar audio speakers is usually in the range of 105-110 db. An audio speaker with a higher sensitivity obviously requires less power, and the sound reproduction ability of such a diaphragm is better.

The membrane of the present application is used to make a diaphragm according to the producing method of the present application by the applicant and the diaphragm is used to make a moving-coil audio speaker. Meanwhile, the overall performance of the moving-coil audio speaker made by the diaphragm of the present application is compared with the overall performance of other moving-coil audio speakers using the same moving-coil component but made by the diaphragms made of other materials. The result shows that the diaphragm made of the membrane according to the present application by the methods disclosed in the present application has an excellent overall performance.

The specific performance will be further described in the detailed description of the preferred embodiments. In a word, the performance of the diaphragm of the present application is significantly improved.

DETAILED DESCRIPTION OF THE PREFERRED EMBODIMENT

The present application will be further described in detail with reference to the preferred embodiments and the accompanying drawings.

Figure 1:
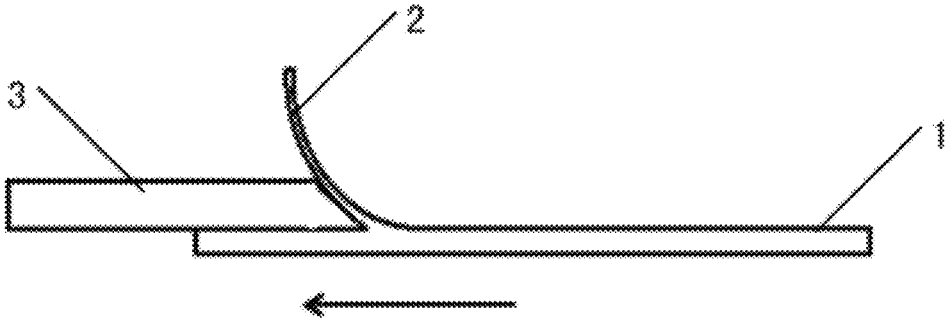
FIG. 1 is a schematic figure for cutting a MCPET baffle during a process of producing a membrane for a diaphragm, according to a first preferred embodiment of the application.
Figure 6:
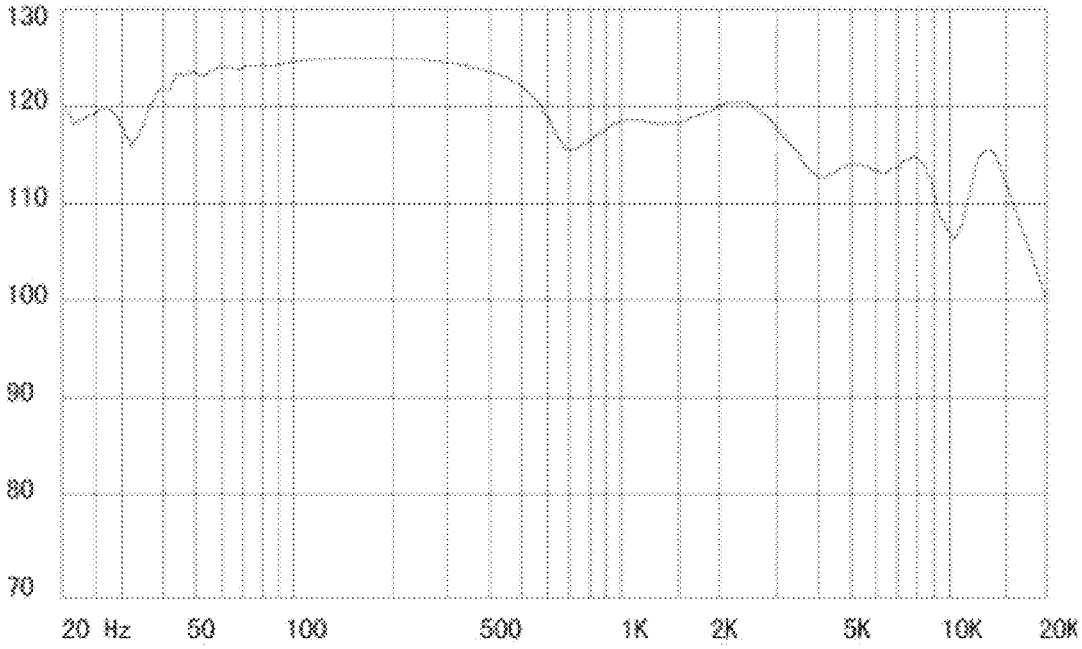
FIG. 6 is a frequency response curve of an audio speaker, according to the membrane of the application.

Example One: the preferred embodiment provides a membrane for producing a diaphragm. The point is that the membrane is made of the MCPET material. The MCPET material is MCPET baffle 1. The MCPET baffle 1 includes micropores 201 which are independent from each other. An average size of the micropore 201 is smaller than 5 μm. A foaming rate of the MCPET baffle 1 is less than 2 times, and a density of the MCPET baffle 1 is less than 300 kg/m$^3$. In the preferred embodiment, a MCPET-VA baffle is specifically used. As shown in FIG. 1, in the preferred embodiment, a cutter 3 is configured to cut the MCPET baffle 1 in layers to form the membrane 2 which is thinner than the MCPET baffle 1 and has a thickness of 0.05-1 mm. The micropores 201 are exposed on at least one surface of the membrane 2 and thus a micropore exposed surface is formed. Of course, after the top layer of the original MCPET baffle 1 is cut in layers, a membrane 2 newly formed will obviously have the micropores 201 exposed on the two surfaces thereof, if the MCPET baffle 1 is further cut. In this case, the membrane 2 has two micropore exposed surfaces. Since the membrane 2 with one micropore exposed surface already has a good performance, for a thicker membrane 2, two micropore exposed surfaces is benefit for improving the performance of the membrane. In the present application, preferably, the thickness of membrane 2 ranges from 0.05 mm to 0.4 mm. A commercially available plate hierarchical machine can be used as the cutting device for cutting. A frequency response characteristics test is performed for the membrane of the preferred example according to the specification of the standards QZ/LCT-QP140-2007 of Longcheer Holdings. The diaphragm of the audio speaker for the test is made of the membrane 2 of the preferred example and the membrane 2 has the following features: the thickness of the membrane 2 is 0.08 mm; the membrane 2 is made of the MCPET-VA baffle; the average size of the micropore 201 is smaller than 5 μm; the foaming rate is 1.8; the density is 235 kg/m$^3$. And the frequency response curve obtained is shown in FIG. 6.

Figure 2:
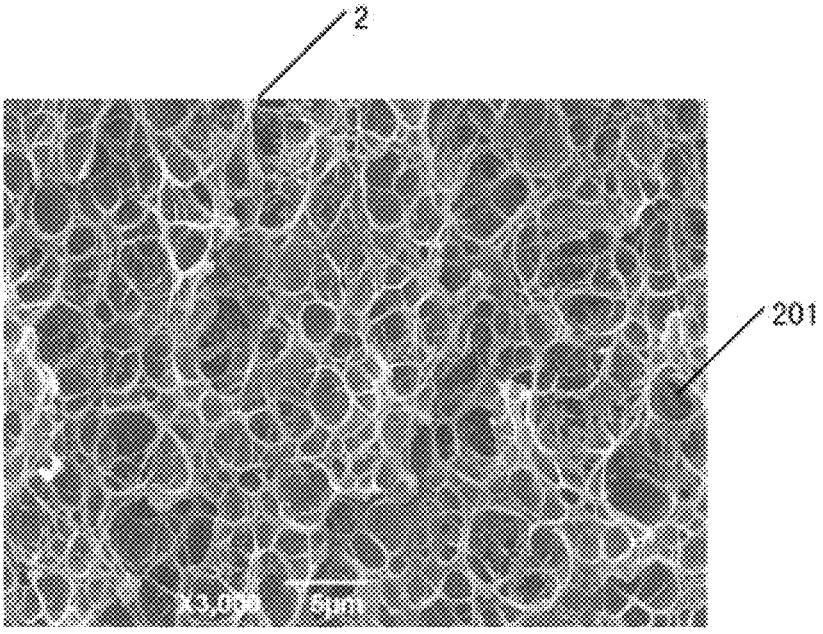
FIG. 2 is a microscopic enlarged view of a micropore exposed surface of the membrane for a diaphragm, according to the first preferred embodiment of the application.
Figure 3:
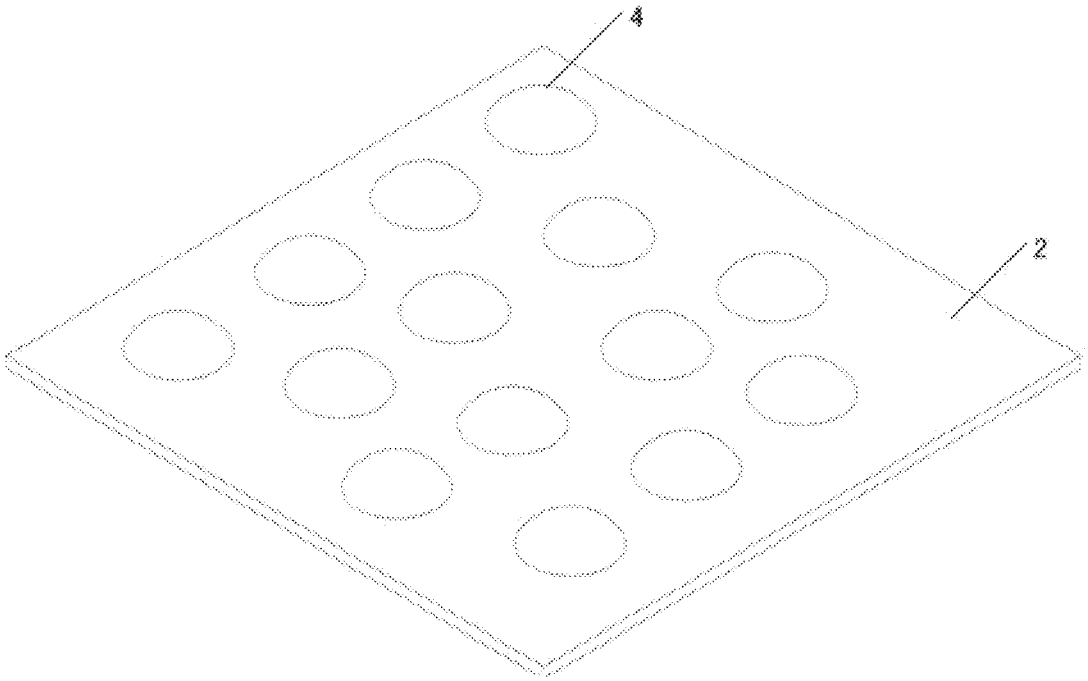
FIG. 3 is a schematic figure of a configuration of a diaphragm formed by a thermoforming an entire membrane, according to an audio speaker diaphragm producing method of a second preferred embodiment of the application.
Figure 4:
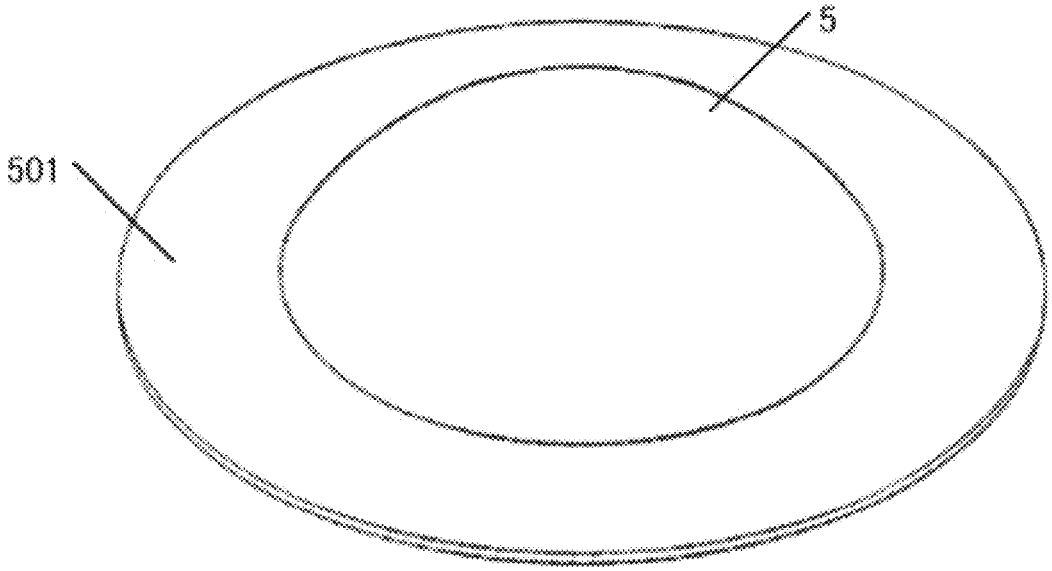
FIG. 4 is a schematic figure of a structure of a dome diaphragm made by the audio speaker diaphragm producing method of the second preferred embodiment using the membrane according to the first preferred embodiment of the application.

Example two, the preferred embodiment provides a method for producing an audio speaker diaphragm. As shown in FIGS. 1, 2, 3, the point is that firstly a MCPET baffle 1 with micropores 201 is cut in layers by a cutter 3 to form a membrane 2 thinner than the MCPET baffle 1; wherein the MCPET baffle 1 has the following features: the micropores 201 are independent from each other; an average size of the micropore 201 is smaller than 5 μm; a foaming rate of the MCPET baffle is less than 2 times; a density of the MCPET baffle is less than 300 kg/m$^3$. The device used for layered cutting is the same as that in the example one. In the preferred embodiment, the MCPET-VA baffle is specifically used. In the preferred embodiment, a thickness of the membrane 2 is 0.05-1 mm. At least one surface with micropores 201 is exposed to form a micropore exposed surface. Then the membrane 2 is heated under a temperature of 130-140° C. to form the diaphragm. In the preferred embodiment, as shown in FIG. 3, the entire membrane 2 is heated to form several dome diaphragm configurations 4 on the entire membrane 2. As shown in FIG. 4, each diaphragm configuration 4 is split from the entire membrane 2 by means of punching or cutting to form the diaphragm 5. When there is only one micropore exposed surface, the surface which is contacted with a mould is micropore non-exposed surface regardless of using the forming method of one surface heating or two surfaces heating.

Figure 5:
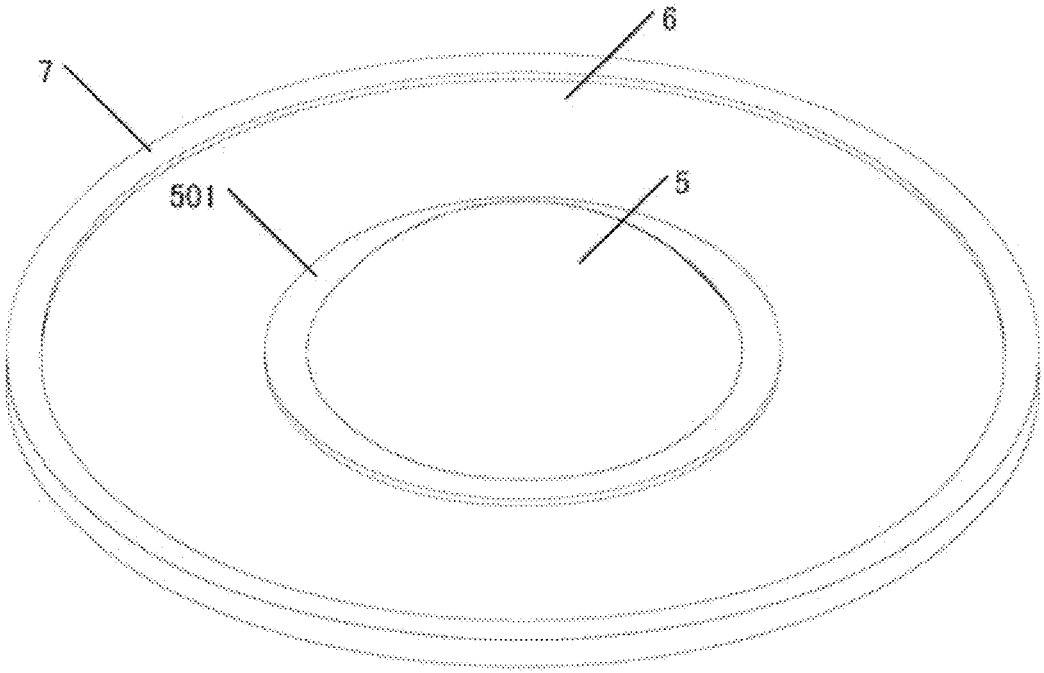
FIG. 5 is a schematic figure of a structure of a composite diaphragm formed by the dome diaphragm made by the audio speaker diaphragm producing method of the second preferred embodiment using the membrane according to the first preferred embodiment of the application.

Example three: it is specially noted that in the following presentation, the diaphragm 5 is also called main diaphragm 5. The preferred embodiment provides an audio speaker composite diaphragm. As shown in FIG. 5, it includes the main diaphragm 5 and an auxiliary diaphragm 6. The main diaphragm 5 is made of a MCPET baffle with micropores and the MCPET baffle has the following features: an average size of the micropore is smaller than or equal to 5 μm; the micropores are independent from each other; a foaming rate of the MCPET baffle is less than 2 times; a density of the MCPET baffle is less than 300 kg/m$^3$. The MCPET baffle is further cut in layers to form a membrane 2. At least one surface of the membrane 2 with micropores 201 is exposed to form a micropore exposed surface. A thickness of the membrane 2 is 0.05-1 mm. The membrane 2 is further heated under a temperature of 130-140° C. to form the main diaphragm 5. The auxiliary diaphragm 6 is in shape of a circular or an annular. An external diameter of the auxiliary diaphragm 6 is larger than an external diameter of the main diaphragm 5. The main diaphragm 5 is superposed on the auxiliary diaphragm 6 and is located at the center of the auxiliary diaphragm 6. Specifically, when there is only one micropore exposed surface on the membrane 2, the micropore exposed surface is opposite to a sound transmission direction of the main diaphragm 5. In the preferred embodiment, the main diaphragm 5 is a dome diaphragm, and an annular connected edge 501 is defined on the main diaphragm 5. The main diaphragm 5 is superposed onto the auxiliary diaphragm 6 via the annular connected edge 501. The main diaphragm 5 and the auxiliary diaphragm 6 are pasted or thermal bonded together to form a composite diaphragm. In the preferred embodiment, the auxiliary diaphragm 6 is made of paper pulp or polymer material, and a stiffening ring 7 is fixed on a cylindrical edge of the auxiliary diaphragm 6.

As shown in table 1, the comprehensive performance of an audio speaker made of the dome diaphragm provided by the example two is compared with the comprehensive performance of an audio speaker made of a diaphragm with the same specifications provided by the prior art.

TABLE 1

| Diaphragm | Diaphragm In The Present Application | PET Diaphragm (the average size of micropore is larger than 10 μm) | Polypropylene Diaphragm | Paper Pulp Diaphragm |
|---|---|---|---|---|
| Thickness (mm) | 0.05 or above | 0.1-0.3 | 0.1-0.3 | 0.35-0.40 |
| Strength | high | high | poor | poor |
| Density (kg/m$^3$) | 200-240 | 1300-1380 | 1100-1200 | 700-800 |
| Sound speed (m/s) | 1950 | 1800 | 1750 | 1600 |
| Energy Loss (tan δ) | 0.04 | 0.046 | 0.065 | 0.035 |
| Sensitivity (dB) | 116 | 110 | 108 | 105 |
| Sound Pressure (dB) | 112-125 | 108-118 | 104-117 | 98-112 |
| Moisture Resistance | good | good | good | poor |
| Ageing Resistance | good | good | poor | poor |
| Comment | low density, high sound speed and good weather fastness ensures high quality sound reproduction | Although obtain high internal loss, density is comparatively high so cannot be used for high quality sound reproduction | Performance similar to the PET diaphragm | Commonly used diaphragm material, but poor weather fastness therefore cannot produce high quality sound |

It can be seen from table 1 that although micropores are defined on the diaphragm made of the membrane of the present application, however, in terms of strength, the diaphragm of the present application is still more superior to the diaphragms made of polypropylene and paper pulp. Moreover, the diaphragm of the present application has lower density and a higher strength compared with existing diaphragms. Table 1 shows that the density of the diaphragm of the present application is obviously lower than the density of diaphragms made of other materials. In limit cases, the density of the diaphragm of the present application is only 15% of the density of diaphragms made of PET materials, 18% of the density of diaphragms made of polypropylene, and 28% of the density of diaphragms made of paper pulp in the prior art. That is to say, compared with diaphragms made of other materials, diaphragm of the present application has lighter weight, a lower density and a higher strength, which makes the diaphragm of the present application more suitable for the audio speaker.

In terms of sound speed, the diaphragm of the present application is 8.3% faster than the diaphragm made of PET materials, 11.4% faster than dual diaphragms made of polypropylene, and 21.8% faster than dual diaphragms made of paper pulp. The higher sound transmission speed fully indicates that the diaphragm of the present application has a good performance in improving the inherent diaphragm viscous phenomenon of the diaphragm made of polymer, and thus the sound transmission speed and the sound reproduction ability are improved.

In terms of the energy loss (Tan δ), the diaphragm of the present application is 13% lower than the diaphragm made of PET materials, 38% lower than the diaphragm made of polypropylene, and only a little higher than the diaphragm made of paper pulp which has the best performance in terms of the energy loss. A relative small energy loss makes the diaphragm much easier to get back to the original shape thereof after a vibration, and this feature ensures sound distortions and sound clippings are maintained at minimum levels throughout sound reproduction process.

In terms of the sound pressure, within a frequency range of 20 Hz-5500 Hz, the sound pressure produced by the diaphragm of the present application ranges from 101 db to 125 db. The result shows that the diaphragm of the present application can reproduce sound at higher audible levels, which is 3.7% higher than the diaphragm made of PET materials in the prior art, 7.6% higher than the diaphragm made of polypropylene, and 14.2% higher than the diaphragm made of paper pulp. And this indicates that, with the same input power, the diaphragm of the present application is able to reproduce higher sound output, which shows superior sound reproduction efficiency.

In terms of moisture resistance and UV Protection, the diaphragm of the present application is obviously better than the diaphragms made of polypropylene and paper pulp, and this feature represents the durability of the diaphragm of the present application when it is used in a long run

The invention claimed is:

1. A membrane for producing a diaphragm, wherein, the membrane is made of MCPET material which is a MCPET baffle with micropores independent from each other; wherein an average size of the micropore is smaller than or equal to 5 μm, a foaming rate of the MCPET baffle is less than 2 times, and a density of the MCPET baffle is less than 300 kg/m$^3$; the MCPET baffle is further processed by means of layered cut to form the membrane thinner than the MCPET baffle being processed with a thickness of the membrane between 0.05-1 mm; and at least one surface with micropores is exposed to form a micropore exposed surface.

2. A method for producing an audio speaker diaphragm using a membrane according to claim 1, comprising: cutting the MCPET baffle with micropores in layers to form the membrane which is thinner than the MCPET baffle being cut and has a thickness of 0.05-1 mm, and heating the membrane under a temperature of 130-140° C. to form the diaphragm; wherein an average size of the micropore is smaller than or equal to 5 μm; the micropores are independent from each other; a foaming rate of the MCPET baffle is less than 300 kg/m$^3$; at least one surface with micropores is exposed to form a micropore exposed surface.

3. The method for producing an audio speaker diaphragm according to claim 2, wherein the entire membrane is heated to form conical diaphragm configurations or dome diaphragm configurations or flat diaphragm configurations with a concave radiating surface; and each diaphragm configuration is further split from the entire diaphragm by means of punching or cutting.

4. The method for producing an audio speaker diaphragm according to claim 2, wherein a forming method of one surface heating or two surface heating is used; when there is only one micropore exposed surface, the surface which is contacted with a mould is micropore non-exposed surface, regardless of using the forming method of one surface heating or two surfaces heating.

5. The method for producing an audio speaker diaphragm according to claim 2, wherein a thickness of the membrane is 0.05-1 mm; a forming method of one surface heating or two surface heating is used; when there is only one micropore exposed surface, the surface which is contacted with a mould is micropore non-exposed surface, regardless of using the forming method of one surface heating or two surfaces heating.

6. An audio speaker composite diaphragm, comprising a main diaphragm and an auxiliary diaphragm, wherein the main diaphragm is made of a MCPET baffle with micropores which are independent from each other and have an average size smaller than or equal to 5 μm; a foaming rate of the MCPET baffle is less than 2 times; a density of the MCPET baffle is less than 300 kg/m$^3$; the MCPET baffle is further cut in layers to form a membrane of the main diaphragm; wherein at least one surface with micropores is exposed to form a micropore exposed surface, and a thickness of the membrane is 0.05-1 mm; the membrane is further heated under a temperature of 130-140° C. to form the main diaphragm; the auxiliary diaphragm is in shape of a circular or an annular; an external diameter of the auxiliary diaphragm is larger than an external diameter of the main diaphragm; and the main diaphragm is superposed on the auxiliary diaphragm and is located at the center of the auxiliary diaphragm.

7. The audio speaker composite diaphragm according to claim 6, wherein when there is only one micropore exposed surface on the membrane, the micropore exposed surface is opposite to a sound transmission direction of the main diaphragm.

8. The audio speaker composite diaphragm according to claim 6, wherein the main diaphragm is a conical diaphragm, a flat diaphragm with a concave radiating surface, or a dome diaphragm.

9. The audio speaker composite diaphragm according to claim 6, wherein an annular connected edge is defined on the main diaphragm; the main diaphragm is superposed onto the auxiliary diaphragm via the annular connected edge; and the main diaphragm and the auxiliary diaphragm are pasted or thermal bonded together to form a composite diaphragm.

10. The audio speaker composite diaphragm according to claim 6, wherein the auxiliary diaphragm is made of paper pulp or polymer material; a stiffening ring is fixed on a cylindrical edge of the auxiliary diaphragm.

* * * * *